US009846394B2

(12) United States Patent
Sawada

(10) Patent No.: US 9,846,394 B2
(45) Date of Patent: Dec. 19, 2017

(54) TRANSFER APPARATUS, IMAGE FORMING APPARATUS AND CLEANING CONTROL METHOD TO HELP PREVENT IMAGE DETERIORATION

(71) Applicant: Konica Minolta, Inc., Chiyoda-ku, Tokyo (JP)

(72) Inventor: Erika Sawada, Kanagawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/335,737

(22) Filed: Oct. 27, 2016

(65) Prior Publication Data

US 2017/0139352 A1 May 18, 2017

(30) Foreign Application Priority Data

Nov. 16, 2015 (JP) ..... 2015-224007

(51) Int. Cl.
*G03G 15/16* (2006.01)

(52) U.S. Cl.
CPC ..... *G03G 15/161* (2013.01)

(58) Field of Classification Search
CPC ..... G03G 15/161; G03G 15/168
USPC ..... 399/101
See application file for complete search history.

(56) References Cited

U.S. PATENT DOCUMENTS 7,035,563 B2 * 4/2006 Sawada ..... G03G 15/168 399/101
7,496,306 B2 * 2/2009 Izumi et al. ..... G03G 15/161 399/101
9,037,021 B2 * 5/2015 Yamaura et al. .... G03G 15/168 399/101

FOREIGN PATENT DOCUMENTS

JP 2007241285 A 9/2007
JP 2007256868 A 10/2007
JP 2016-102940 A 6/2016

OTHER PUBLICATIONS

Office Action (Notice of Reasons for Rejection) dated Sep. 19, 2017, by the Japanese Patent Office in rresponding Japanese Patent Application No. 2015-224007, with an English translation of the Office Action. (7 pages).

* cited by examiner

*Primary Examiner* — William J Royer
(74) *Attorney, Agent, or Firm* — Buchanan Ingersoll & Rooney PC

(57) ABSTRACT

A transfer apparatus includes an image bearing member, a transfer member, a cleaning-bias output section, a first resistance-state detector, a second resistance-state detector, and a controller configured to control the cleaning-bias output section based on a first resistance state and a second resistance state, so as to change timing of ending outputting of a cleaning bias.

20 Claims, 6 Drawing Sheets

TRANSFER APPARATUS, IMAGE FORMING APPARATUS AND CLEANING CONTROL METHOD TO HELP PREVENT IMAGE DETERIORATION

CROSS REFERENCE TO RELATED APPLICATIONS

This application is entitled to and claims the benefit of Japanese Patent Application No. 2015-224007, filed on Nov. 16, 2015, the disclosure of which including the specification, drawings and abstract is incorporated herein by reference in its entirety.

BACKGROUND OF THE INVENTION

1. Field of the Invention

The present invention relates to a transfer apparatus, an image forming apparatus and a cleaning control method.

2. Description of Related Art

Image forming apparatuses using an electrophotographic process technology (printer, copier, facsimile or the like) generally form an electrostatic latent image by irradiating (exposing) a charged photoconductor with laser light based on image data. Toner is supplied from a developing device to a photoconductor drum (image carrier) on which the electrostatic latent image is formed, and the electrostatic latent image is thereby visualized to form a toner image. Furthermore, the toner image is directly or indirectly transferred to a sheet, heated, pressurized and fixed by a fixing nip, and a toner image is thereby formed on the sheet.

In such an image forming apparatus, for example, a transfer roller which forms the transfer nip between itself and an intermediate transfer belt (image carrier) is in contact with the intermediate transfer belt. For that reason, a toner zone supplied to the intermediate transfer belt when a cleaning member of the intermediate transfer belt is cleaned or a discharge toner zone when deteriorated toner inside the developing device is discharged is likely to be transferred to the transfer roller which is in contact with the intermediate transfer belt. When the toner is transferred to the transfer roller, back surface stain of a sheet may occur when a printing operation is resumed.

In the case of a transfer roller in a configuration without any cleaning mechanism such as a blade or brush, the transfer roller is cleaned by applying a bias to the transfer roller when paper is not passing therethrough and thereby returning the toner on the transfer roller to the intermediate transfer belt.

For example, according to a technique described in Japanese Patent Application Laid-Open No. 2007-241285, when the transfer roller is cleaned, a positive polarity bias and a negative polarity bias corresponding to one circumference of the transfer roller are alternately applied to the transfer roller. This allows the positive polarity toner and negative polarity toner adhering to the transfer roller to be returned to the intermediate transfer belt.

When toner remains on the transfer roller at the time of cleaning, back surface stain of the sheet may occur during printing, and it is therefore necessary to reliably remove stain of the transfer roller. Therefore, a long cleaning time may be set so that the cleaning operation can be continued until stain of the transfer roller disappears.

However, since the appropriate cleaning time varies depending on a degree of toner adhesion to the transfer roller, a degree of deterioration of the surface of the transfer roller and an operating environment of the image forming apparatus, the cleaning operation may be excessively continued in some cases. Since such an excessive cleaning operation is carried out during cleaning of the intermediate transfer belt after the printing operation is stopped, there is a concern that productivity in image formation may deteriorate.

SUMMARY OF THE INVENTION

An object of the present invention is to provide a transfer apparatus, an image forming apparatus and a cleaning control method that can prevent deterioration of productivity in image formation when a transfer member is cleaned.

To achieve at least one of the objects mentioned above, a transfer apparatus reflecting one aspect of the present invention includes: an image bearing member capable of bearing a toner image; a transfer member configured to form a transfer nip between the transfer member and the image bearing member to transfer the toner image borne on the image bearing member to a sheet; a cleaning-bias output section configured to output, at timing at which the toner image is not transferred to the sheet, a cleaning bias for cleaning the toner image that adheres to the transfer member; a first resistance-state detector configured to detect, when the toner image is less likely to adhere to the transfer member, a resistance state of the transfer member as a first resistance state; a second resistance-state detector configured to detect, when the toner image is highly likely to adhere to the transfer member and when the cleaning-bias output section outputs the cleaning bias, a resistance state of the transfer member as a second resistance state; and a controller configured to control the cleaning-bias output section based on the first resistance state detected by the first resistance-state detector and the second resistance state detected by the second resistance-state detector, so as to change timing of ending outputting of the cleaning bias.

Preferably, the timing for detecting the first resistance state and the second resistance state is timing corresponding to an interval between a plurality of sheets when continuous image formation is performed on the plurality of sheets in the transfer apparatus.

Preferably, in the transfer apparatus, when the second resistance-state detector detects the resistance state of the transfer member, the controller detects a plurality of the resistance states detected by the second resistance-state detector within a period corresponding to one rotation of the transfer member, for every first time composed of a certain time period and determines the resistance state that is a largest value among the plurality of detected resistance states, as the second resistance state.

Preferably, in the transfer apparatus, the controller detects, within a period during which the first resistance-state detector detects the resistance state of the transfer member, a plurality of the resistance states detected by the first resistance-state detection section for every second time composed of a certain time period and determines whether or not to adopt the resistance state as the first resistance state in accordance with a difference between a largest value and a smallest value among the plurality of detected resistance states.

Preferably, the transfer apparatus, further includes a contact/separation section configured to cause the image bearing member and the transfer member to contact with or separate from each other, in which: when a contact or separation time necessary to cause the image bearing member and the transfer member to separate from each other while the image bearing member and the transfer member are in contact with each other, and then cause the image bearing member and the transfer member to come into contact with each other is shorter than a cleaning time for cleaning the transfer member, the controller causes the image bearing member and the transfer member to separate from each other and controls the contact/separation section and the cleaning-bias output section such that outputting of the cleaning bias is not performed.

Preferably, in the transfer apparatus, the cleaning bias is composed of a bias with a polarity identical to that of the toner image and a bias with a polarity opposite to that of the toner image, the biases being switched alternately.

Preferably, in the transfer apparatus, the controller changes the timing of ending cleaning of the transfer member in accordance with a type of the sheet.

Preferably, in the transfer apparatus, the controller determines whether or not to replace the transfer member in accordance with a cleaning history of the transfer member.

Preferably, in the transfer apparatus, the controller determines whether or not to replace the transfer member in accordance with an amount of fluctuation of the second resistance state during a third time when the cleaning-bias output section outputs the cleaning bias.

Preferably, in the transfer apparatus, the controller determines whether or not to replace the transfer member in accordance with a use history of the transfer member.

Preferably, in the transfer apparatus, the transfer member is a rotating body.

To achieve at least one of the objects mentioned above, an image forming apparatus reflecting one aspect of the present invention includes: an image bearing member capable of bearing a toner image; a transfer member configured to form a transfer nip between the transfer member and the image bearing member to transfer the toner image borne on the image bearing member to a sheet; a cleaning-bias output section configured to output, at timing at which the toner image is not transferred to the sheet, a cleaning bias for cleaning the toner image that adheres to the transfer member; a first resistance-state detector configured to detect, when the toner image is less likely to adhere to the transfer member, a resistance state of the transfer member as a first resistance state; a second resistance-state detector configured to detect, when the toner image is highly likely to adhere to the transfer member and when the cleaning-bias output section outputs the cleaning bias, a resistance state of the transfer member as a second resistance state; and a controller configured to control the cleaning-bias output section based on the first resistance state detected by the first resistance-state detection section and the second resistance state detected by the second resistance-state detection section, so as to change timing of ending outputting of the cleaning bias.

To achieve at least one of the objects mentioned above, a cleaning control method reflecting one aspect of the present invention is a method for a transfer apparatus comprising an image bearing member capable of bearing a toner image, a transfer member configured to form a transfer nip between the transfer member and the image bearing member to transfer the toner image borne on the image bearing member to a sheet and a cleaning-bias output section that outputs, at timing at which the toner image is not transferred to the sheet, a cleaning bias for cleaning the toner image that adheres to the transfer member, the method including: detecting, when the toner image is less likely to adhere to the transfer member, a resistance state of the transfer member as a first resistance state; detecting, when the toner image is highly likely to adhere to the transfer member and when the cleaning-bias output section outputs the cleaning bias, a resistance state of the transfer member as a second resistance state; and controlling the cleaning-bias output section based on the first resistance state and the second resistance state, so as to change timing of ending outputting of the cleaning bias.

Preferably, in the cleaning control method, the timing for detecting the first resistance state and the second resistance state is timing corresponding to an interval between a plurality of sheets when continuous image formation is performed on the plurality of sheets.

Preferably, in the cleaning control method, when the toner image is highly likely to adhere to the transfer member and when the cleaning-bias output section outputs the cleaning bias, within a period corresponding to one rotation of the transfer member, a plurality of the detected resistance states of the transfer member is detected in for every first time composed of a certain time period, and a resistance state corresponding to a largest value among the plurality of detected resistance states is determined as the second resistance state.

Preferably, in the cleaning control method, when the toner image is less likely to adhere to the transfer member, within a period during which a resistance state of the transfer member is detected, a plurality of the detected resistance states are detected for every second time composed of a certain time period, and whether or not to adopt the resistance state as the first resistance state is determined in accordance with a difference between a largest value and a smallest value of the plurality of detected resistance states.

Preferably, in the cleaning control method, the transfer apparatus further includes a contact/separation section configured to cause the image bearing member and the transfer member to contact with or separate from each other, in which: when a contact or separation time necessary to cause the image bearing member and the transfer member to separate from each other while the image bearing member and the transfer member are in contact with each other, and then cause the image bearing member and the transfer member to come into contact with each other is shorter than a cleaning time for cleaning the transfer member, the controller causes the image bearing member and the transfer member to separate from each other and controls the contact/separation section and the cleaning-bias output section such that outputting of the cleaning bias is not performed.

Preferably, in the cleaning control method, the cleaning bias is composed of a bias with a polarity identical to that of the toner image and a bias with a polarity opposite to that of the toner image, the biases being switched alternately.

Preferably, in the cleaning control method, the timing of ending cleaning of the transfer member is changed in accordance with a type of the sheet.

Preferably, in the cleaning control method, whether or not to replace the transfer member is determined in accordance with a cleaning history of the transfer member.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
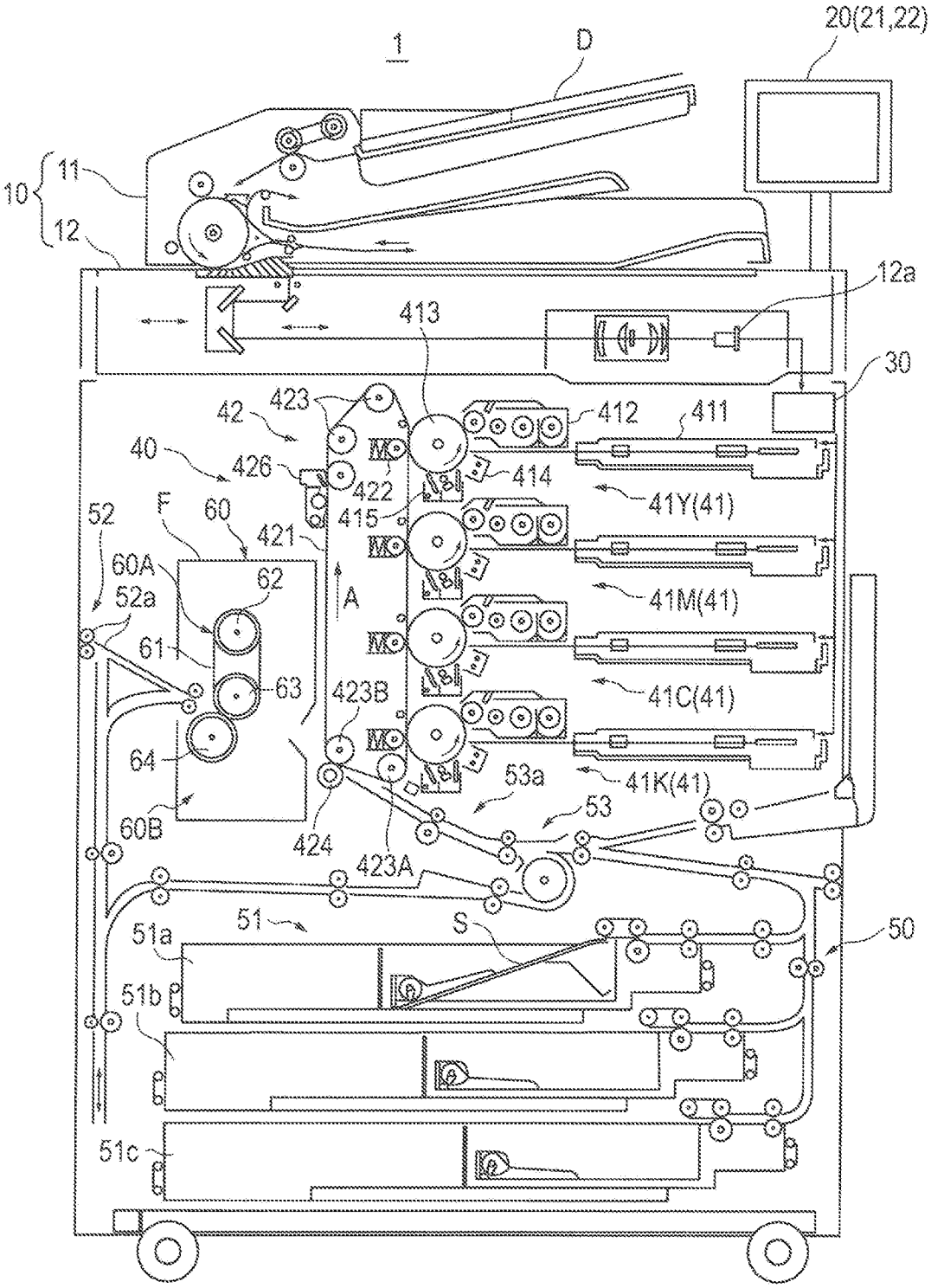
FIG. 1 is a diagram schematically illustrating an overall configuration of an image forming apparatus according to the present embodiment.
Figure 2:
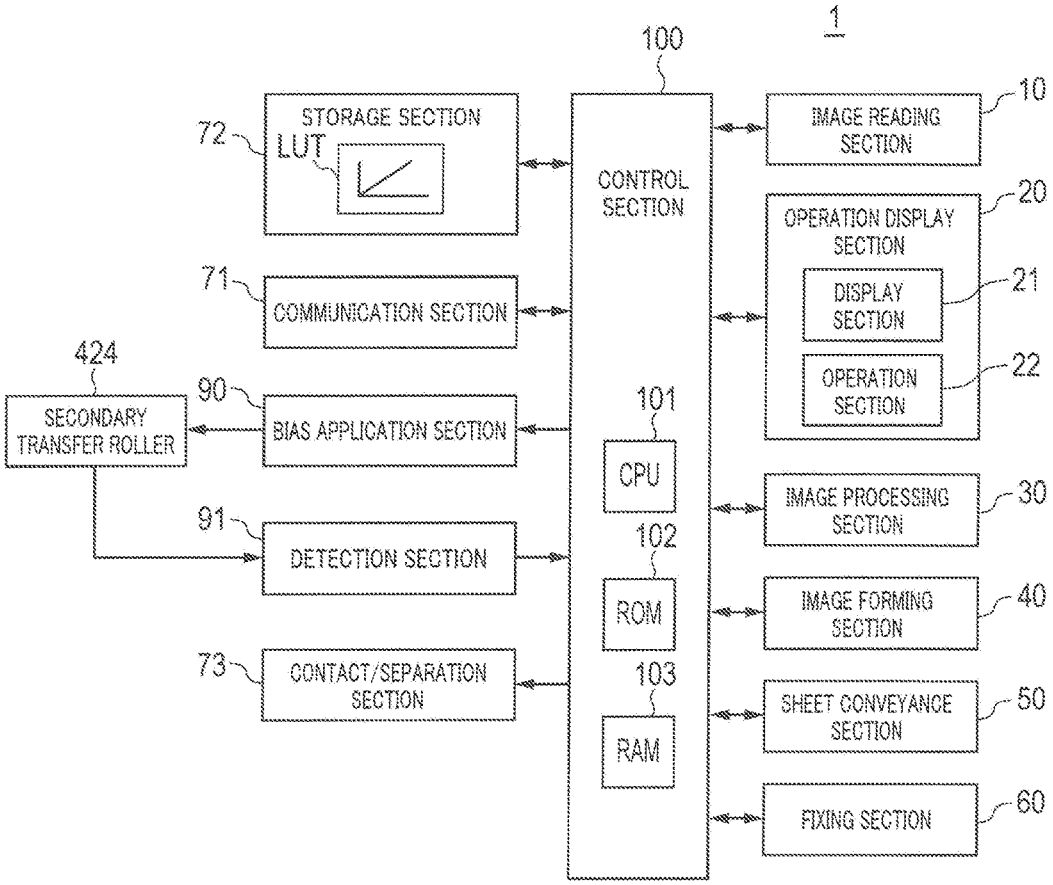
FIG. 2 is a diagram illustrating main components of a control system of the image forming apparatus according to the present embodiment.

Hereinafter, an embodiment of the present invention will be described in detail with reference to the accompanying drawings. FIG. 1 is a diagram schematically illustrating an overall configuration of image forming apparatus 1 according to the present embodiment. FIG. 2 is a diagram illustrating main components of a control system of image forming apparatus 1 according to the present embodiment.

Image forming apparatus 1 shown in FIGS. 1 and 2 is a color-image forming apparatus of intermediate transfer system using an electrophotographic process technology. That is, image forming apparatus 1 forms an image by primary-transferring toner images formed in different colors of Y (yellow), M (magenta), C (cyan) and K (black) on photoconductor drum 413 to intermediate transfer belt 421, superimposing the four color toner images one on another on intermediate transfer belt 421 and then secondary-transferring the superimposed image to sheet S.

Image forming apparatus 1 adopts a tandem system in which photoconductor drums 413 corresponding to four YMCK colors are arranged in series in a traveling direction of intermediate transfer belt 421 and toner images of the respective colors are sequentially transferred to intermediate transfer belt 421 by one procedure.

Image forming apparatus 1 includes image reading section 10, operation display section 20, image processing section 30, image forming section 40, sheet conveyance section 50, fixing section 60 and control section 100.

Control section 100 includes CPU (central processing unit) 101, ROM (read only memory) 102, RAM (random access memory) 103 or the like. CPU 101 reads a program corresponding to processing contents from ROM 102, develops the program on RAM 103, and intensively controls operation of each block of image forming apparatus 1 in cooperation with the developed program. In this case, various kinds of data stored in storage section 72 are referenced. Storage section 72 is constructed of, for example, a non-volatile semiconductor memory (so-called flash memory) or a hard disk drive.

Control section 100 transmits and receives various kinds of data to and from external devices (e.g., personal computer) connected to a communication network such as a local area network (LAN) or a wide area network (WAN) via communication section 71. Control section 100 receives, for example, image data (input image data) transmitted from the external apparatus and forms an image on sheet S based on the image data. Communication section 71 is made up of a communication control card such as a LAN card.

Image reading section 10 includes auto document feeding device 11 called "auto document feeder (ADF)" and document image scanning device 12 (scanner) or the like.

Auto document feeding device 11 conveys document D placed on a document tray through a conveyance mechanism and sends document D to document image scanning device 12. Auto document feeding device 11 allows images (including both sides) of a large number of pieces of document D placed on the document tray to be consecutively read at once.

Document image scanning device 12 optically scans a document conveyed from auto document feeding device 11 onto contact glass or a document placed on the contact glass, forms an image of reflected light from the document on a light receiving surface of charge coupled device (CCD) sensor 12*a* and reads the document image. Image reading section 10 generates input image data based on the reading result from document image scanning device 12. The input image data is subjected to predetermined image processing by image processing section 30.

Operation display section 20 is composed of, for example, a liquid crystal display (LCD) with a touch panel and functions as display section 21 and operation section 22. Display section 21 displays various operation screens, states of images and operation situations or the like of the respective functions according to display control signals inputted from control section 100. Operation section 22 includes various operation keys such as a numerical keypad or a start key, receives various input operations from a user and outputs operation signals to control section 100.

Image processing section 30 includes a circuit that performs digital image processing corresponding to an initial setting or user setting on the input image data. For example, image processing section 30 performs gradation correction based on gradation correction data (gradation correction table) under the control of control section 100. Image processing section 30 performs various correction processes such as color correction, shading correction and compression process in addition to gradation correction on the input image data. Image forming section 40 is controlled based on the image data subjected to these processes.

Image forming section 40 includes image forming units 41Y, 41M, 41C and 41K for forming images using colored toners of a Y component, an M component, a C component and a K component based on the input image data, and intermediate transfer unit 42 or the like.

Image forming units 41Y, 41M, 41C and 41K for the Y component, M component, C component and K component have similar configurations respectively. For convenience of illustration and description, common components are shown by the same reference numerals and when components are distinguished, their reference numerals are appended by Y, M, C and K. In FIG. 1, only components of Y component image forming unit 41Y are assigned reference numerals and reference numerals of components of other image forming units 41M, 41C and 41K are omitted.

Image forming unit 41 includes exposing device 411, developing device 412, photoconductor drum 413, charging device 414 and drum cleaning device 415 or the like.

Photoconductor drum 413 is a negative charging type organic photoconductor (OPC) formed by successively laminating an undercoat layer (UCL), a charge generation layer (CGL) and a charge transport layer (CTL) on a circumferential surface of, for example, an aluminum conductive cylindrical body (aluminum pipe).

Charging device 414 uniformly charges the surface of photoconductor drum 413 having photoconductivity to a negative polarity by generating corona discharge.

Exposing device 411 is constructed of, for example, a semiconductor laser and irradiates photoconductor drum 413 with laser light corresponding to an image of each color component. A positive charge is generated in the charge generation layer of photoconductor drum 413, conveyed to the surface of the charge transport layer, whereby the surface charge (negative charge) of photoconductor drum 413 is neutralized. An electrostatic latent image of each color component is formed on the surface of photoconductor drum 413 due to a potential difference from the periphery.

Developing device 412 is a two-component reverse rotation type developing device and forms a toner image by causing toner of each color component to adhere to the surface of photoconductor drum 413 and thereby visualizing an electrostatic latent image. Developing device 412 forms a toner image on the surface of photoconductor drum 413 by supplying toner contained in a developer to photoconductor drum 413.

Drum cleaning device 415 includes a drum cleaning blade which is in slide contact with the surface of photoconductor drum 413 and removes residual transferred toner remaining on the surface of photoconductor drum 413 after a primary transfer.

Intermediate transfer unit 42 includes intermediate transfer belt 421, primary transfer roller 422, a plurality of support rollers 423, secondary transfer roller 424 and belt cleaning device 426 or the like. Intermediate transfer belt 421 corresponds to an "image bearing member" of the present invention and secondary transfer roller 424 corresponds to a "transfer member" of the present invention.

Intermediate transfer belt 421 is constructed of an endless belt and is stretched in a loop shape among a plurality of support rollers 423. At least one of plurality of support rollers 423 is constructed of a drive roller 423A and the other rollers are constructed of driven rollers. When the drive roller 423A rotates, intermediate transfer belt 421 travels in direction A at a certain speed.

Intermediate transfer belt 421 is a conductive and elastic belt and has a high resistance layer having a volume resistivity of 8 to 11 [log Ω·cm] on the surface. Intermediate transfer belt 421 is driven to rotate by a control signal from control section 100. Note that intermediate transfer belt 421 can be any kind of belt if it is a conductive and elastic belt, regardless of its material, thickness and hardness.

Primary transfer roller 422 is disposed on an inner circumferential surface side of intermediate transfer belt 421 opposite to photoconductor drum 413 of each color component. Primary transfer roller 422 is brought into pressure-contact with photoconductor drum 413 via intermediate transfer belt 421 interposed therebetween and a primary transfer nip for transferring a toner image from photoconductor drum 413 to intermediate transfer belt 421 is thereby formed.

Secondary transfer roller 424 includes a member having excellent resistance uniformity made of an ion conductive material such as nitrile rubber, epichlorohydrin rubber.

Secondary transfer roller 424 is disposed on an outer circumferential surface side of intermediate transfer belt 421 opposite to backup roller 423B disposed on a downstream side in a belt running direction of drive roller 423A. Secondary transfer roller 424 is brought into pressure-contact with backup roller 423B via intermediate transfer belt 421 interposed therebetween and a secondary transfer nip for transferring a toner image from intermediate transfer belt 421 to sheet S is thereby formed. The secondary transfer nip corresponds to a "transfer nip" of the present invention.

Secondary transfer roller 424 moves between a contact position at which it comes into contact with intermediate transfer belt 421 and a separation position at which it separates from intermediate transfer belt 421 by control section 100 controlling contact/separation section 73. Secondary transfer roller 424 is controlled so as to be located at the separation position when printing is not in progress, and located at the contact position along with a printing operation.

Belt cleaning device 426 removes residual transferred toner remaining on the surface of intermediate transfer belt 421 after a secondary transfer.

When intermediate transfer belt 421 passes through the primary transfer nip, toner images on photoconductor drums 413 are sequentially primary-transferred to intermediate transfer belt 421 so as to overlap one on another. More specifically, by applying a primary transfer bias to primary transfer roller 422 and applying a charge with a polarity opposite to that of the toner to the back side of intermediate transfer belt 421, that is, the side contacting primary transfer roller 422, the toner images are electrostatically transferred to intermediate transfer belt 421.

After that, when sheet S passes through the secondary transfer nip, the toner images on intermediate transfer belt 421 are secondary-transferred to sheet S. More specifically, by applying a secondary transfer bias to backup roller 423B through bias application section 90 and applying a charge with the same polarity as that of the toner to the surface side of sheet S, that is, the side contacting intermediate transfer belt 421, the toner images are electrostatically transferred to sheet S. Bias application section 90 corresponds to a "cleaning-bias output section" of the present invention.

Bias application section 90 indirectly applies a bias of a constant current to secondary transfer roller 424 via backup roller 423B under the control of control section 100. Detection section 91 (a detector) is connected to secondary transfer roller 424 and detection section 91 detects a resistance state, that is, a voltage value of secondary transfer roller 424. Detection section 91 corresponds to a "first resistance-state detection section" and a "second resistance-state detection section" of the present invention. Furthermore, intermediate transfer unit 42, bias application section 90, detection section 91 and control section 100 correspond to a "transfer apparatus" of the present invention.

Fixing section 60 includes upper-side fixing section 60A having a fixing surface side member disposed on the surface side where toner images are formed and which is a fixing surface of sheet S and lower-side fixing section 60B having a back-side support member disposed on the surface side which is opposite to the fixing surface and which is the back side of sheet S. A fixing nip to nip and convey sheet S is formed by causing the back-side support member to be in pressure-contact with the fixing surface side member.

Fixing section 60 heats and pressurizes, through the fixing nip, conveyed sheet S to which toner images are secondary-transferred, to thereby fix the toner images to sheet S. Fixing section 60 is disposed in fixing device F as a unit. An air separation unit that separates sheet S from the fixing surface side member or the back-side support member by blowing air may be disposed in fixing device F.

Upper-side fixing section 60A includes endless fixing belt 61 which is a fixing surface side member, heating roller 62 and fixing roller 63. Fixing belt 61 is suspended in a stretched manner between heating roller 62 and fixing roller 63.

Heating roller 62 incorporates a heating source (halogen heater) to heat fixing belt 61. Heating roller 62 is heated by the heating source, and fixing belt 61 is heated as a consequence.

Fixing roller 63 is driven and controlled by control section 100 to rotate in a clockwise direction. When fixing roller 63 rotates, fixing belt 61 and heating roller 62 are driven to rotate in a clockwise direction.

Lower-side fixing section 60B includes pressurizing roller 64 which is a back-side support member. Pressurizing roller 64 forms a fixing nip that conveys sheet S nipped between itself and fixing belt 61. Pressurizing roller 64 is driven and controlled by control section 100 to rotate in a counterclockwise direction.

Sheet conveyance section 50 includes sheet feeding section 51, sheet ejection section 52 and conveyance path section 53 or the like. Three sheet feed trays 51*a* to 51*c* that constitute sheet feeding section 51 accommodate sheets S (standard sheet and special sheet) which are identified based on their basis weight or size or the like for each type set in advance. Conveyance path section 53 includes a plurality of conveyance roller pairs such as registration roller pairs 53*a*.

Sheets S accommodated in sheet feed trays 51*a* to 51*c* are sent by conveyance path section 53 one by one starting from a topmost sheet and conveyed to image forming section 40. In this case, a registration roller section in which registration roller pairs 53*a* are disposed corrects the inclination of sheets S which are fed and adjusts conveyance timing. In image forming section 40, toner images on intermediate transfer belt 421 are secondary-transferred to one side of sheet S all together, and in fixing section 60, the toner images are subjected to fixing steps. Sheets S on which images are formed, are ejected out of the apparatus by sheet ejection section 52 provided with sheet ejection roller 52*a*.

In the present embodiment, belt cleaning device 426 is cleaned during a printing operation at a rate of, for example, once after every predetermined number of sheets (e.g., 500 sheets) are printed. More specifically, the blade of belt cleaning device 426 is cleaned by forming a toner zone as a lubricant on intermediate transfer belt 421.

The toner zone can be formed to a width corresponding to the entire length in the longitudinal direction of secondary transfer roller 424 and to an appropriate length (e.g., 160 mm), but the toner zone is not limited to this. However, the toner zone is preferably formed to a length corresponding to one circumference or more of secondary transfer roller 424 from the viewpoint of detection accuracy of voltage detection values in detection section 91 during cleaning of secondary transfer roller 424 which will be described later.

Since secondary transfer roller 424 that forms a secondary transfer nip between itself and intermediate transfer belt 421 is in contact with intermediate transfer belt 421, toner in the toner zone is likely to transfer to secondary transfer roller 424 at the secondary transfer nip during cleaning of belt cleaning device 426.

Figure 3:
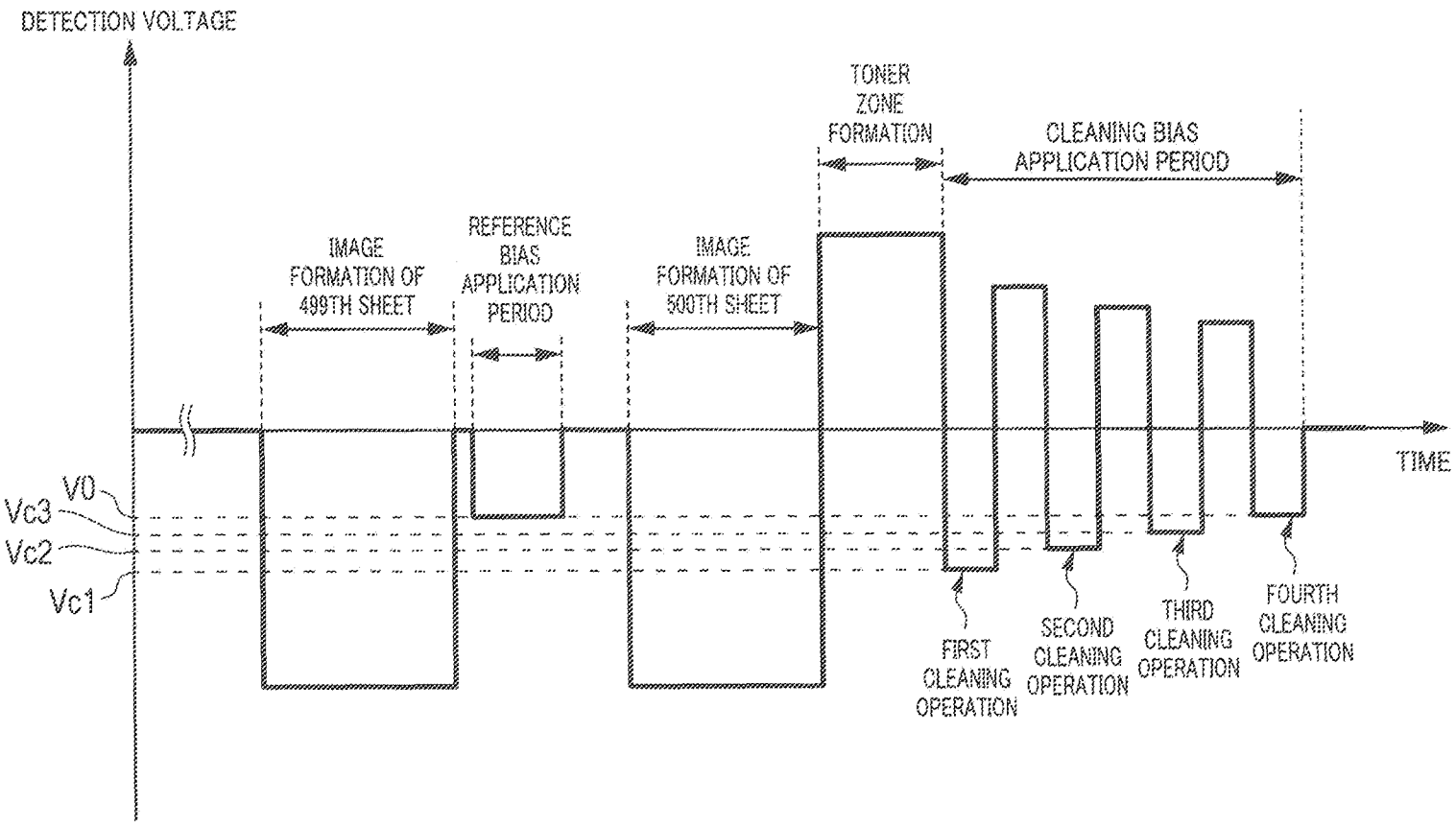
FIG. 3 is a time chart of detection voltages when a bias is applied to a secondary transfer roller.

More specifically, as shown in FIG. 3, while the toner zone is being formed, a bias with a positive polarity which is opposite to that of the toner charged to a negative polarity is applied to secondary transfer roller 424 via backup roller 423B to prevent the toner on intermediate transfer belt 421 from moving to secondary transfer roller 424. FIG. 3 shows detection voltages at secondary transfer roller 424.

As for the toner on intermediate transfer belt 421, part of the toner may be weakly charged or positively charged and such toner moves from intermediate transfer belt 421 to secondary transfer roller 424.

When toner is transferred to secondary transfer roller 424, back surface staining of the sheet occurs when the printing operation is resumed, and therefore when belt cleaning device 426 is cleaned, secondary transfer roller 424 also needs to be cleaned together.

The amount of cleaning of secondary transfer roller 424 varies depending on a degree of adhesion of toner to secondary transfer roller 424, a degree of deterioration of secondary transfer roller 424 and an operating environment of image forming apparatus 1. For that reason, a longer cleaning time may be set to reliably remove stain of secondary transfer roller 424. However, setting a longer cleaning time may result in excessive cleaning in some cases. Thus, since cleaning of secondary transfer roller 424 is performed after the printing operation is stopped and during cleaning of belt cleaning device 426, productivity in image formation may deteriorate.

Thus, in the present embodiment, control section 100 performs control so as to change timing of ending cleaning of secondary transfer roller 424 according to a situation and thereby prevents deterioration of productivity in image formation caused by excessive cleaning. Hereinafter, detailed control by control section 100 will be described.

When intermediate transfer belt 421 is not bearing any toner image, that is, when a possibility of toner images adhering to secondary transfer roller 424 is low, control section 100 controls bias application section 90 so as to apply a reference bias to secondary transfer roller 424. The reference bias is a bias different from the secondary transfer bias and an absolute value thereof is set to a value smaller than the secondary transfer bias. Note that the case with the low possibility of toner images adhering to secondary transfer roller 424 refers to a case where when images are consecutively formed on a plurality of sheets, no toner zone is formed at a time interval between two successive sheets.

More specifically, control section 100 controls bias application section 90 so as to apply the reference bias to secondary transfer roller 424 between a period during which an image is formed on the 499th sheet and a period during which another image is formed on the next 500th sheet.

Control section 100 calculates reference value V0 which is a voltage value of secondary transfer roller 424 when the reference bias is applied to secondary transfer roller 424 during the reference bias application period. Reference value V0 is a voltage value calculated in a resistance state detected by detection section 91. A method of calculating reference value V0 will be described later. The resistance state when reference value V0 is calculated corresponds to a "first resistance state" of the present invention.

When there is a high possibility of toner images adhering to secondary transfer roller 424, control section 100 controls bias application section 90 so as to apply a cleaning bias to secondary transfer roller 424. Note that the high possibility of toner images adhering to secondary transfer roller 424 refers to timing at which no toner image is transferred to sheets, that is, a case where a toner zone is formed at timing corresponding to an interval between a plurality of sheets when images are consecutively formed on the plurality of sheets and after the toner zone passes through the secondary transfer nip.

The cleaning bias is made up of a pulse waveform in which a negative polarity bias having the same polarity as that of toner and a positive polarity bias having a polarity opposite to that of toner are repeated alternately. Absolute values of the respective biases of the cleaning bias are set to a current value equal to an absolute value of the reference bias. Note that when secondary transfer roller 424 is a new product, the reference bias in the present embodiment is set to such a value that control section 100 can detect, for example, 1500V, but the reference bias can be changed as appropriate in accordance with the embodiment.

Each period of the alternately repeated negative polarity bias and positive polarity bias corresponds to a time required for secondary transfer roller 424 to make one turn.

A mixture of toner charged to a positive polarity and toner charged to a negative polarity adheres to secondary transfer roller 424. For that reason, by applying the above cleaning bias to secondary transfer roller 424, the positive polarity toner is moved from secondary transfer roller 424 to intermediate transfer belt 421 when a negative polarity bias is applied and the negative polarity toner is moved from secondary transfer roller 424 to intermediate transfer belt 421 when a positive polarity bias is applied. In this way, secondary transfer roller 424 is cleaned.

Control section 100 determines a voltage detection value of secondary transfer roller 424 when the cleaning bias is applied to secondary transfer roller 424 as cleaning value Vc. Note that in the following description, an operation of determining cleaning value Vc is assumed to be called a cleaning operation, and the cleaning operation is performed when a negative polarity bias is applied in the present embodiment.

Cleaning value Vc is a voltage value calculated in a resistance state detected by detection section 91. A method of calculating cleaning value Vc will be described later. The resistance state when cleaning value Vc is calculated corresponds to a "second resistance state" of the present invention.

When toner adheres to secondary transfer roller 424, the absolute value of cleaning value Vc is greater than that when toner does not adhere to secondary transfer roller 424, that is, reference value V0. This is attributable to the fact that since the reference bias and the cleaning bias are currents of the same absolute value, when toner adheres to secondary transfer roller 424, the resistance value of secondary transfer roller 424 increases.

When control section 100 determines cleaning value Vc, control section 100 determines timing of ending cleaning of secondary transfer roller 424 according to the difference between cleaning value Vc and reference value V0. Note that the following description assumes that reference value V0 and cleaning value Vc, and the difference between reference value V0 and cleaning value Vc are absolute values.

More specifically, when the difference between reference value V0 and cleaning value Vc is equal to or less than a predetermined threshold, control section 100 ends the cleaning of secondary transfer roller 424. The predetermined threshold is theoretically preferably 0V, but it may be set to on the order of 20V by taking a detection error or the like in detection section 91 into account.

When the difference between reference value V0 and cleaning value Vc is greater than the predetermined threshold, control section 100 repeatedly performs cleaning operation. To be more specific, in the first cleaning operation in FIG. 3, since the cleaning value is Vc1 which is a value greater than reference value V0, the process proceeds to a second cleaning operation.

Control section 100 repeatedly executes the second cleaning operation and the third cleaning operation, and cleaning value Vc gradually decreases to Vc2 and Vc3 as secondary transfer roller 424 is cleaned through each cleaning operation. Control section 100 executes the fourth cleaning operation and when the cleaning value becomes equal to reference value V0, control section 100 ends the cleaning in secondary transfer roller 424 at this timing.

Note that regarding the timing of ending the cleaning operation, the cleaning operation may be immediately ended when the difference between reference value V0 and cleaning value Vc falls to or below a predetermined threshold or may be ended after executing a preliminary operation in a short time. For example, when the cleaning operation comes to an end at the first cleaning operation, the cleaning operation may be controlled so as to be performed a certain number of times before ending the cleaning.

Control section 100 may also change the timing of ending the cleaning in accordance with the type of sheets. From the viewpoint of preventing back surface stain of sheets, since how easily stain on secondary transfer roller 424 transfers to sheets varies depending on the type of sheets, it is preferable to change the predetermined threshold in accordance with the type of sheets. For example, in the case of sheets with high surface smoothness such as coated paper, stain on secondary transfer roller 424 is likely to transfer, and therefore the predetermined threshold is preferably set to a smaller value.

Figure 4:
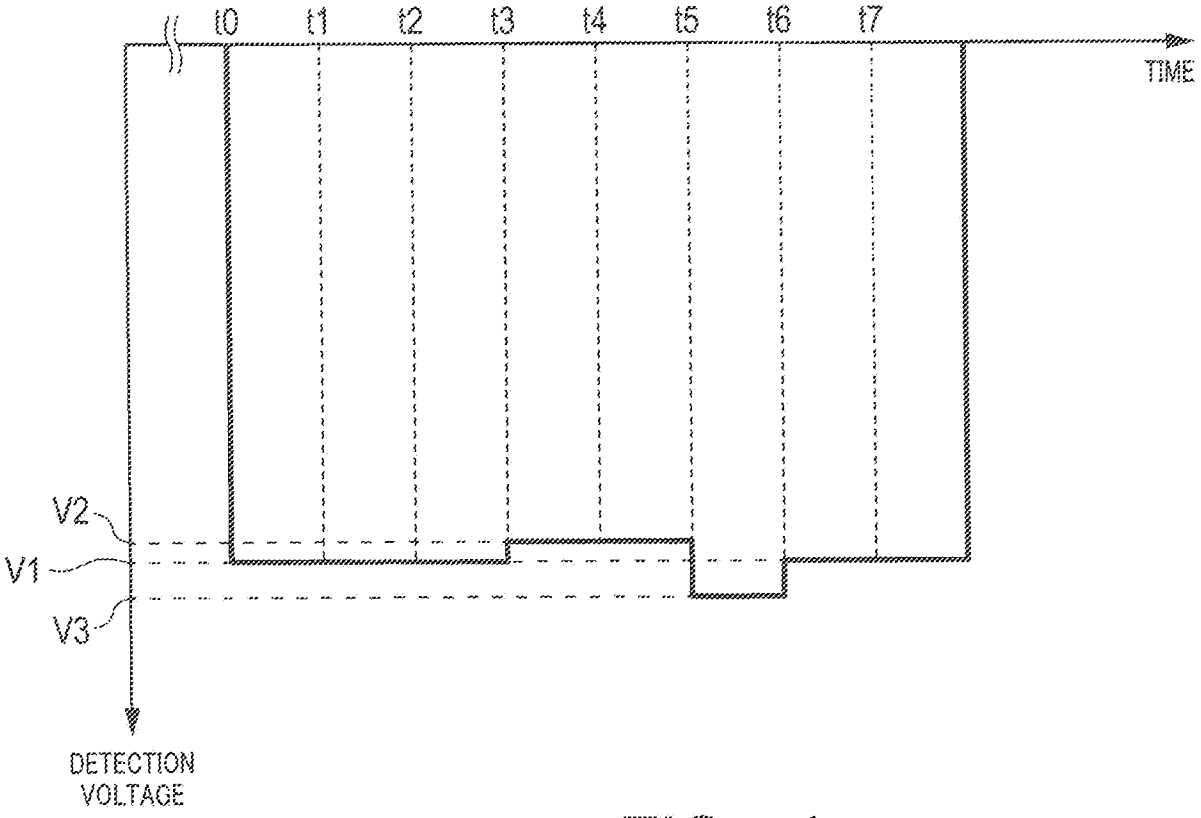
FIG. 4 is a diagram provided for describing calculation of cleaning values or a reference value.

Next, a method of calculating cleaning value Vc and reference value V0 will be described. FIG. 4 is a diagram provided for describing calculations of cleaning value Vc or reference value V0.

As shown in FIG. 4, cleaning value Vc is calculated for a period corresponding to one rotation of secondary transfer roller 424 under a cleaning bias. More specifically, after time t0 at which the cleaning bias is changed to a negative polarity bias, and from time t1 onward, at which there are no more influences such as noise and values of detection voltages are estimated to become stable, control section 100 detects a plurality of voltage values of secondary transfer roller 424 at every predetermined period of time. The predetermined period of time in this description corresponds to a "first time" of the present invention.

In FIG. 4, voltage values of secondary transfer roller 424 for a total of six periods of time t1 to t2, time t2 to t3, time t3 to t4, time t4 to t5, time t5 to t6 and time t6 to t7 are detected. More specifically, control section 100 detects first voltage V1 from time t1 to t2, time t2 to t3 and time t6 to t7, second voltage V2 from time t3 to t4 and time t4 to t5, and third voltage V3 from time t5 to t6.

Control section 100 determines the largest value among the plurality of detection values as cleaning value Vc for this period. In FIG. 4, third voltage V3 which is the largest value among a total of six detection values is determined as cleaning value Vc.

Since there may be irregularities in the amount of toner adhesion in a circumferential direction of secondary transfer roller 424, cleaning value Vc is determined in this way to remove toner at a location where the detection values become largest, that is, a most stained location.

Reference value V0 is calculated from the detection values of secondary transfer roller 424 during a reference bias application period. More specifically, control section 100 detects a plurality of voltage values of secondary transfer roller 424 at every certain period of time after time t0 at which reference bias application starts as in the case of cleaning value Vc. The certain period of time in this description corresponds to a "second time" of the present invention.

Control section 100 determines reference value V0 in accordance with a difference between the largest value and the smallest value of detection values. In the case of FIG. 4, reference value V0 is determined in accordance with the difference between third voltage V3 which is a largest value and second voltage V2 which is a smallest value of the detection values.

More specifically, when the absolute value of the difference between the largest value and the smallest value of the detection values is equal to or lower than a second predetermined threshold (e.g., 30 V), control section 100 adopts an average value of the detection values over a reference bias application period, more specifically, the period from time t1 to t7 as reference value V0. When reference value V0 is adopted, control section 100 stores the reference value V0 in storage section 72.

When the difference between the largest value and the smallest value of the detection values is greater than the second predetermined threshold, control section 100 immediately stops printing control or executes a cleaning operation before starting a printing operation on the next sheet.

One reason for this is that when the user makes a setting mistake in sheet size or when a full-bleed image, that is, a borderless image is formed over an entire printing surface, secondary transfer roller 424 may be stained unexpectedly. For that reason, reference value V0 which should originally be detected when secondary transfer roller 424 is not stained may not be correctly detected, making it impossible to clean secondary transfer roller 424 appropriately, producing back surface staining in the next sheet to be printed.

Reference value V0 is calculated before image formation of the 500th sheet which is the sheet immediately before the toner zone formation, but the present invention is not limited to this, and reference value V0 may be calculated before image formation of the 498th sheet. However, since the resistance value in secondary transfer roller 424 may fluctuate as an ambient temperature rises, reference value V0 is preferably calculated at timing as close as possible to timing of toner zone formation. Furthermore, reference value V0 may also be calculated all the time between sheets on which images are formed.

When the reference bias and the cleaning bias cannot be applied to secondary transfer roller 424 as biases made up of the same current value, a resistance value in a first resistance state of secondary transfer roller 424 at the time of reference bias application may be compared with a resistance value in a second resistance state of secondary transfer roller 424 at the time of cleaning bias application, and a cleaning operation may be performed so that the resistance value in the second resistance state approximates to the resistance value in the first resistance state.

Figure 5:
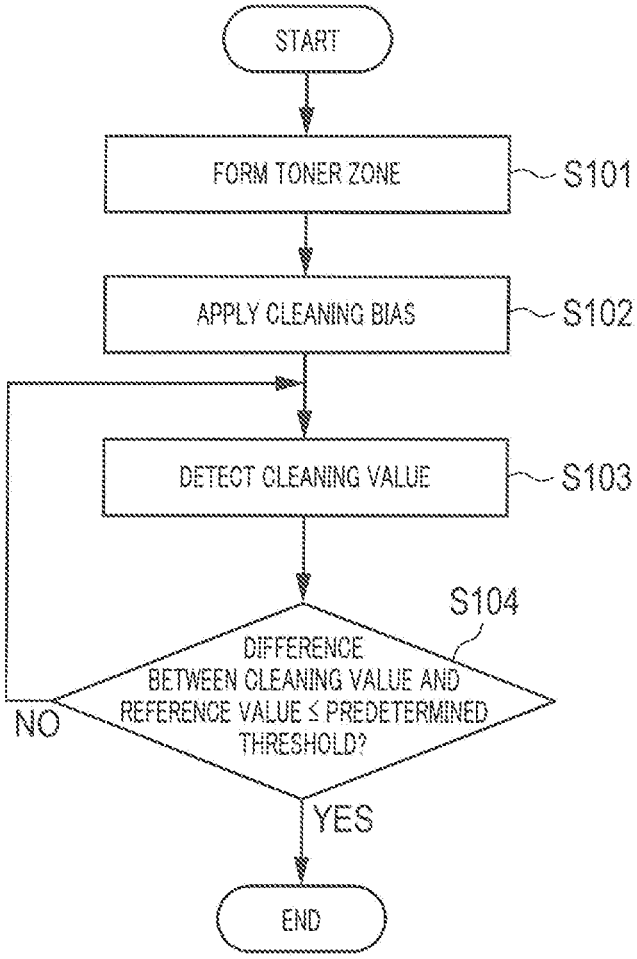
FIG. 5 is a flowchart illustrating an operation example of cleaning control by the image forming apparatus according to the present embodiment.

Next, an operation example of cleaning control in image forming apparatus 1 provided with above-described control section 100 will be described. FIG. 5 is a flowchart illustrating an operation example of cleaning control on image forming apparatus 1. The processing in FIG. 5 are executed when control section 100 receives an instruction for executing toner zone formation.

As shown in FIG. 5, control section 100 controls image forming section 40 so as to form a toner zone (step S101). Next, control section 100 controls bias application section 90 so as to apply a cleaning bias to secondary transfer roller 424 (step S102).

Next, control section 100 detects cleaning value Vc in the first cleaning operation detected by detection section 91 (step S103). Next, control section 100 determines whether a difference between cleaning value Vc and reference value V0 is equal to or less than a predetermined threshold (step S104).

When the determination result shows that the difference of reference value V0 from cleaning value Vc is greater than the predetermined threshold (step S104, NO), the process returns to step S103. On the other hand, when the difference of reference value V0 from cleaning value Vc is equal to or less than the predetermined threshold (step S104, YES), control section 100 ends this control.

As described in detail above, image forming apparatus 1 according to the present embodiment includes intermediate transfer belt 421 that can bear a toner image, secondary transfer roller 424 that forms a secondary transfer nip to transfer the toner image carried by intermediate transfer belt 421 between itself and intermediate transfer belt 421 to a sheet, bias application section 90 that outputs a cleaning bias to clean the toner image adhering to secondary transfer roller 424 at timing when the toner image is not transferred to the sheet, detection section 91 that detects, when a possibility of the toner image adhering to secondary transfer roller 424 is low, a resistance state of secondary transfer roller 424 as a first resistance state and detects, when the possibility of the toner image adhering to secondary transfer roller 424 is high and a cleaning bias is outputted by bias application section 90, the resistance state of secondary transfer roller 424 as a second resistance state, and control section 100 that controls bias application section 90 so as to change timing of ending outputting of the cleaning bias based on the first resistance state and the second resistance state detected by detection section 91.

According to the present embodiment configured as described above, it is possible to perform appropriate cleaning in accordance with the degree of toner adhesion to secondary transfer roller 424, the degree of deterioration of the surface of secondary transfer roller 424 and the operating environment of image forming apparatus 1. When cleaning secondary transfer roller 424, it is thereby possible to prevent excessive cleaning and prevent deterioration of productivity in image formation.

Next, image forming apparatus 1 according to a modification will be described. When a contact/separation time between secondary transfer roller 424 and intermediate transfer belt 421 is shorter than a cleaning time for cleaning secondary transfer roller 424, control section 100 according to the modification controls contact/separation section 73 and bias application section 90 so as to separate intermediate transfer belt 421 from secondary transfer roller 424 and not to output a cleaning bias.

The contact/separation time is a time required to move secondary transfer roller 424 from a contact position where intermediate transfer belt 421 is in contact with secondary transfer roller 424 to a separation position and move secondary transfer roller 424 to the contact position again. For the contact/separation time, a time on the order of 4 to 5 seconds is required in consideration of influences of vibration on image formation when secondary transfer roller 424 moves to a transfer position with respect to intermediate transfer belt 421.

On the other hand, the cleaning time for cleaning secondary transfer roller 424 normally ends in approximately 1 to 2 seconds, but the cleaning time may be excessively long when the environment condition around image forming apparatus 1 is one in which it is hard to clean secondary transfer roller 424 such as a high temperature high humidity environment or when the surface of secondary transfer roller 424 is deteriorated. The cleaning time is assumed to indicate the cleaning bias application period in FIG. 3.

When the cleaning time is excessively long, for example, during formation of a toner zone, a printing operation may be resumed more quickly by separating secondary transfer roller 424 from intermediate transfer belt 421 to clean intermediate transfer belt 421 and causing secondary transfer roller 424 to contact intermediate transfer belt 421 without performing any cleaning operation on secondary transfer roller 424.

For that reason, in the modification, cleaning operation on secondary transfer roller 424 is not performed in such a case and it is thereby possible to resume the printing operation quickly.

Storage section 72 stores cleaning times set through experiments or the like in advance and the cleaning times are successively updated in storage section 72 every time a cleaning operation is performed in secondary transfer roller 424.

Figure 6:
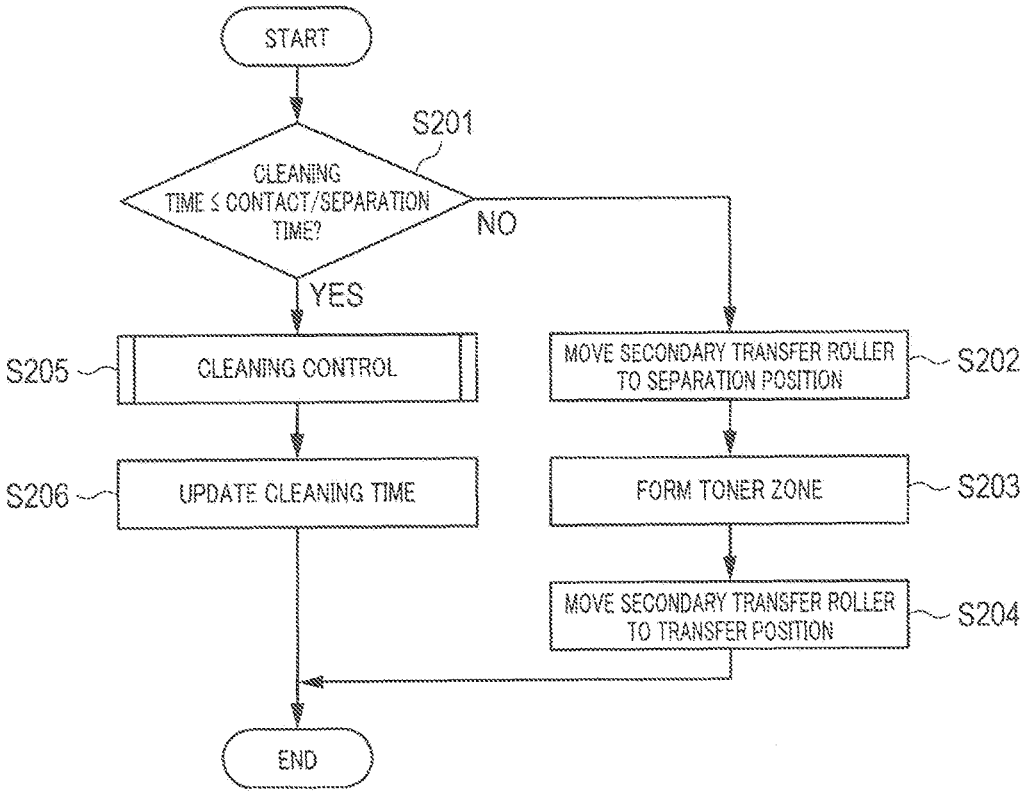
FIG. 6 is a flowchart illustrating an operation example of cleaning control by an image forming apparatus according to a modification.

An operation example of cleaning control of image forming apparatus 1 according to the modification will be described. FIG. 6 is a flowchart illustrating an operation example of cleaning control by image forming apparatus 1 according to the modification. Processes in FIG. 6 are executed when control section 100 receives an instruction for executing toner zone formation.

As shown in FIG. 6, control section 100 determines whether the cleaning time is equal to or less than a contact/separation time (step S201). When the determination result shows that the cleaning time is greater than the contact/separation time (step S201, NO), control section 100 moves secondary transfer roller 424 to the separation position (step S202).

Next, control section 100 controls image forming section 40 so as to form a toner zone (step S203). Next, after the toner zone passes through the position corresponding to the secondary transfer nip, control section 100 moves secondary transfer roller 424 to a transfer position (step S204) and ends the control.

On the other hand, when the cleaning time is equal to or less than the contact/separation time (step S201, YES), control section 100 performs cleaning control similar to that in FIG. 3 (step S205). Next, control section 100 updates the cleaning time in storage section 72 to the cleaning time in step S205 (step S206), and ends the control.

According to such a configuration, it is possible to resume printing control quickly under a condition under which cleaning takes an excessively long time.

Once the processing proceeds to control in steps S202 to S204 in FIG. 6, the cleaning time is not updated after the transition, so that the control is always performed even when the cleaning time is extended in a high temperature high humidity environment or when secondary transfer roller 424 is cleaned or replaced. In consideration of this, for example, in an initial cleaning operation when power to image forming apparatus 1 is turned on, control may be unconditionally performed so as to execute the process in step S205 in FIG. 6.

Furthermore, control section 100 may also determine whether or not to replace secondary transfer roller 424 in accordance with a cleaning history, for example, a cleaning time of secondary transfer roller 424, or determine whether or not to replace secondary transfer roller 424 in accordance with a use history, for example, the operating frequency of secondary transfer roller 424.

When secondary transfer roller 424 is frequently used and the surface of secondary transfer roller 424 deteriorates, the cleaning time becomes excessively long, and therefore secondary transfer roller 424 needs to be replaced. For that reason, control section 100 may perform control so as to determine that secondary transfer roller 424 should be replaced when the cleaning time exceeds a predetermined time (e.g., 5 seconds) or when the operating frequency of secondary transfer roller 424 exceeds a predetermined frequency (e.g., 80%).

Control section 100 may also determine whether or not secondary transfer roller 424 should be replaced in accordance with the amount of fluctuation of cleaning value Vc during a certain time.

In the case of secondary transfer roller 424 having high cleaning performance, most of toner adhering to secondary transfer roller 424 is moved to intermediate transfer belt 421 through the first cleaning operation. For that reason, when the amount of fluctuation of each cleaning value within a period of the first cleaning operation and the second cleaning operation is equal to or less than a predetermined amount (e.g., 10V), control section 100 can perform control so as to determine that the cleaning performance of secondary transfer roller 424 is low and determine that secondary transfer roller 424 should be replaced. The certain time in this description corresponds to a "third time" of the present invention.

Upon determining that secondary transfer roller 424 should be replaced, control section 100 may display a warning prompting replacement of secondary transfer roller 424 on display section 21 or the like.

Note that the above embodiment has described a toner zone formed on intermediate transfer belt 421 to clean belt cleaning device 426, but the present invention is not limited to this. The toner may be, for example, discharged toner which is deteriorated toner in developing device 414 which is discharged into an image carrier or may be a patch image to detect image concentration.

The above embodiment uses a voltage detection value of secondary transfer roller 424 when a negative polarity bias is applied to detect cleaning value Vc, but the present invention is not limited to this, and may use a voltage detection value of secondary transfer roller 424 when a positive polarity bias is applied.

The above embodiment has described the bias as a constant current, but the present invention is not limited to this, and the bias may be a constant voltage. The cleaning value and reference value in this case may be detected as current values.

In the above embodiment, a secondary transfer bias is applied to secondary transfer roller 424 via backup roller 423B, but the present invention is not limited to this, and may also be configured such that the secondary transfer bias is directly applied to secondary transfer roller 424.

The above embodiment has described intermediate transfer type secondary transfer roller 424 as an example of a transfer member, but the present invention is not limited to this, and secondary transfer roller 424 may be a direct transfer type transfer roller in which the photoconductor drum is in direct contact with a transfer roller. The transfer member may be a rotating body like a belt member such as the secondary transfer belt in the secondary transfer unit instead of a roller member.

The above embodiment has described color image forming apparatus 1 as an example of the image forming apparatus, but the present invention is not limited to this, and image forming apparatus 1 may be a monochrome image forming apparatus.

When the apparatus stops due to sheet jamming or printing control stops in emergency due to an abnormality in the apparatus, the stopping period is not predictable. For this reason, a time difference between a time at which reference value V0 is detected and a time at which cleaning value Vc is detected increases excessively so that the resistance value of secondary transfer roller 424 fluctuates with time, preventing an accurate cleaning operation from being performed. In such a case, it may be optionally determined whether or not to perform cleaning control.

In addition, the above embodiment has merely described an example of implementation of the present invention and the technical scope of the present invention should not be restrictively interpreted. That is, the present invention can be implemented without departing from the spirit and scope or main features of the present invention.

What is claimed is:

1. A transfer apparatus comprising:

an image bearing member capable of bearing a toner image;

a transfer member configured to form a transfer nip between the transfer member and the image bearing member to transfer the toner image borne on the image bearing member to a sheet;

a cleaning-bias output section configured to output, at timing at which the toner image is not transferred to the sheet, a cleaning bias for cleaning the toner image that adheres to the transfer member;

a first resistance-state detector configured to detect, when the toner image is less likely to adhere to the transfer member, a resistance state of the transfer member as a first resistance state;

a second resistance-state detector configured to detect, when the toner image is highly likely to adhere to the transfer member and when the cleaning-bias output section outputs the cleaning bias, a resistance state of the transfer member as a second resistance state; and a controller configured to control the cleaning-bias output section based on the first resistance state detected by the first resistance-state detector and the second resistance state detected by the second resistance-state detector, so as to change timing of ending outputting of the cleaning bias.

2. The transfer apparatus according to claim 1, wherein the timing for detecting the first resistance state and the second resistance state is timing corresponding to an interval between a plurality of sheets when continuous image formation is performed on the plurality of sheets.

3. The transfer apparatus according to claim 1, wherein, when the second resistance-state detector detects the resistance state of the transfer member, the controller detects a plurality of the resistance states detected by the second resistance-state detector within a period corresponding to one rotation of the transfer member, for every first time composed of a certain time period and determines the resistance state that is a largest value among the plurality of detected resistance states, as the second resistance state.

4. The transfer apparatus according to claim 1, wherein the controller detects, within a period during which the first resistance-state detector detects the resistance state of the transfer member, a plurality of the resistance states detected by the first resistance-state detector for every time composed of a certain time period and determines whether or not to adopt the resistance state as the first resistance state in accordance with a difference between a largest value and a smallest value among the plurality of detected resistance states.

5. The transfer apparatus according to claim 1, further comprising a contact/separation section configured to cause the image bearing member and the transfer member to contact with or separate from each other, wherein:

when a contact or separation time necessary to cause the image bearing member and the transfer member to separate from each other while the image bearing member and the transfer member are in contact with each other, and then cause the image bearing member and the transfer member to come into contact with each other is shorter than a cleaning time for cleaning the transfer member, the controller causes the image bearing member and the transfer member to separate from each other and controls the contact/separation section and the cleaning-bias output section such that outputting of the cleaning bias is not performed.

6. The transfer apparatus according to claim 1, wherein the cleaning bias is composed of a bias with a polarity identical to that of the toner image and a bias with a polarity opposite to that of the toner image, the biases being switched alternately.

7. The transfer apparatus according to claim 1, wherein the controller changes the timing of ending cleaning of the transfer member in accordance with a type of the sheet.

8. The transfer apparatus according to claim 1, wherein the controller determines whether or not to replace the transfer member in accordance with a cleaning history of the transfer member.

9. The transfer apparatus according to claim 1, wherein the controller determines whether or not to replace the transfer member in accordance with an amount of fluctuation of the second resistance state during a time when the cleaning output section outputs the cleaning bias.

10. The transfer apparatus according to claim 1, wherein the controller determines whether or not to replace the transfer member in accordance with a use history of the transfer member.

11. The transfer apparatus according to claim 1, wherein the transfer member is a rotating body.

12. An image forming apparatus comprising:

an image bearing member capable of bearing a toner image;

a transfer member configured to form a transfer nip between the transfer member and the image bearing member to transfer the toner image borne on the image bearing member to a sheet;

a cleaning-bias output section configured to output, at timing at which the toner image is not transferred to the sheet, a cleaning bias for cleaning the toner image that adheres to the transfer member;

a first resistance-state detector configured to detect, when the toner image is less likely to adhere to the transfer member, a resistance state of the transfer member as a first resistance state;

a second resistance-state detector configured to detect, when the toner image is highly likely to adhere to the transfer member and when the cleaning-bias output section outputs the cleaning bias, a resistance state of the transfer member as a second resistance state; and a controller configured to control the cleaning-bias output section based on the first resistance state detected by the first resistance-state detector and the second resistance state detected by the second resistance-state detector, so as to change timing of ending outputting of the cleaning bias.

13. A cleaning control method for a transfer apparatus comprising an image bearing member capable of bearing a toner image, a transfer member configured to form a transfer nip between the transfer member and the image bearing member to transfer the toner image borne on the image bearing member to a sheet and a cleaning-bias output section that outputs, at timing at which the toner image is not transferred to the sheet, a cleaning bias for cleaning the toner image that adheres to the transfer member, the method comprising:

detecting, when the toner image is less likely to adhere to the transfer member, a resistance state of the transfer member as a first resistance state;

detecting, when the toner image is highly likely to adhere to the transfer member and when the cleaning-bias output section outputs the cleaning bias, a resistance state of the transfer member as a second resistance state; and controlling the cleaning-bias output section based on the first resistance state and the second resistance state, so as to change timing of ending outputting of the cleaning bias.

14. The cleaning control method according to claim 13, wherein the timing for detecting the first resistance state and the second resistance state is timing corresponding to an interval between a plurality of sheets when continuous image formation is performed on the plurality of sheets.

15. The cleaning control method according to claim 13, wherein, when the toner image is highly likely to adhere to the transfer member and when the cleaning-bias output section outputs the cleaning bias, within a period corresponding to one rotation of the transfer member, a plurality of the detected resistance states of the transfer member is detected in for every time composed of a certain time period, and a resistance state corresponding to a largest value among the plurality of detected resistance states is determined as the second resistance state.

16. The cleaning control method according to claim 13, wherein, when the toner image is less likely to adhere to the transfer member, within a period during which a resistance state of the transfer member is detected, a plurality of the detected resistance states are detected for every time composed of a certain time period, and whether or not to adopt the resistance state as the first resistance state is determined in accordance with a difference between a largest value and a smallest value of the plurality of detected resistance states.

17. The cleaning control method according to claim 13, wherein:

the transfer apparatus further comprises a contact/separation section configured to cause the image bearing member and the transfer member to contact with or separate from each other, wherein:

when a contact or separation time necessary to cause the image bearing member and the transfer member to separate from each other while the image bearing member and the transfer member are in contact with each other, and then cause the image bearing member and the transfer member to come into contact with each other is shorter than a cleaning time for cleaning the transfer member, the controller causes the image bearing member and the transfer member to separate from each other and controls the contact/separation section and the cleaning-bias output section such that outputting of the cleaning bias is not performed.

18. The cleaning control method according to claim 13, wherein the cleaning bias is composed of a bias with a polarity identical to that of the toner image and a bias with a polarity opposite to that of the toner image, the biases being switched alternately.

19. The cleaning control method according to claim 13, wherein the timing of ending cleaning of the transfer member is changed in accordance with a type of the sheet.

20. The cleaning control method according to claim 13, wherein whether or not to replace the transfer member is determined in accordance with a cleaning history of the transfer member.

* * * * *